US006605584B2

(12) United States Patent
Fong et al.

(10) Patent No.: US 6,605,584 B2
(45) Date of Patent: Aug. 12, 2003

(54) ANTIMICROBIAL HARD SURFACE CLEANER COMPRISING AN ETHOXYLATED QUATERNARY AMMONIUM SURFACTANT

(75) Inventors: Ronald A. Fong, San Ramon, CA (US); Stephen B. Kong, Alamo, CA (US); David Peterson, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 0 days.

(21) Appl. No.: 09/849,660

(22) Filed: May 4, 2001

(65) Prior Publication Data

US 2003/0064910 A1 Apr. 3, 2003

(51) Int. Cl.[7] ..... C11D 1/835; C11D 1/62

(52) U.S. Cl. ..... 510/384; 510/238; 510/243; 510/245; 510/254; 510/259; 510/356; 510/362; 510/365; 510/382; 510/391; 510/421; 510/432; 510/504

(58) Field of Search ..... 510/238, 243, 510/245, 254, 259, 356, 362, 365, 382, 384, 391, 421, 432, 504

(56) References Cited

U.S. PATENT DOCUMENTS 5,962,388 A * 10/1999 Sherry et al. ..... 510/238
6,358,900 B1 * 3/2002 Wigley et al. ..... 510/180

* cited by examiner

*Primary Examiner*—Charles Boyer
(74) *Attorney, Agent, or Firm*—Joel J. Hayashida

(57) ABSTRACT

The invention provides a, non- or minimized streaking/filming antimicrobial formulation, the cleaner containing:

a. an akoxylated quaternary ammonium surfactant, present in a cleaning-effective amount;

b. an alkoxylated short chain nonionic surfactant, also present in a cleaning-effective amount;

c. alkanolamine as an alkalinity source, present in an amount effective to enhance soil removal in said cleaner;

d. a quaternary ammonium compound in an amount present for antimicrobial efficacy;

e. at least one water-soluble or dispersible organic solvent having a vapor pressure of at least 0.001 mm Hg at 25° C., said at least one organic solvent present in a solubilizing—or dispersion—effective amount; and f. the remainder, water.

6 Claims, 3 Drawing Sheets

GREASY SOIL PERFORMANCE

GREASY SOIL PERFORMANCE

FILMING AND STREAKING PERFORMANCE

ANTIMICROBIAL HARD SURFACE CLEANER COMPRISING AN ETHOXYLATED QUATERNARY AMMONIUM SURFACTANT

BACKGROUND OF THE INVENTION

1. Field of the Invention

The invention relates to an all purpose, no-rinse, hard surface cleaner which also has antimicrobial efficacy.

2. Brief Statement of the Related Art

There are a variety of hard surface cleaners. Exemplary ones include Baker et al., U.S. Pat. No. 4,960,779, which shows an all purpose liquid cleaner with reduced streaking and filming.

Another cleaner is disclosed in Graubart et al., U.S. Pat. No. 5,454,984, namely, a cleaning composition comprising quaternary ammonium compounds, tetrasodium EDTA, a mixture of surfactants, and a glycol ether. However, the reference fails to teach, disclose or suggest the use of a modified quaternary amine to enhance cleaning and filming/streaking performance.

Other hard surface cleaners which have antimicrobial efficacy include Zhou et al., U.S. Pat. No. 6,013,615, and Zhou et al., U.S. Pat. No. 6,080,387, both of common assignment, and incorporated herein by reference.

However, none of the art discloses, teaches or suggests the use of a modified quaternary ammonium compounds which additionally surprisingly enhances the soil removing ability and streaking/filming performance of the liquid, one phase cleaners formulated therewith, despite the presence of both quaternary ammonium compounds and the modified quaternary ammonium compounds. In addition, the inventive cleaners retain their antimicrobial performance.

SUMMARY OF THE INVENTION AND OBJECTS

The invention provides an antimicrobial, aqueous, hard surface cleaner, said cleaner comprising:

a. an alkoxylated quaternary ammonium surfactant, present in a cleaning-effective amount;

b. an alkoxylated short chain nonionic surfactant, also present in a cleaning-effective amount;

c. alkanolamine as an alkalinity source present in an amount effective to enhance soil removal in said cleaner;

d. a quaternary ammonium compound in an amount present for antimicrobial efficacy;

e. at least one water-soluble or dispersible organic solvent having a vapor pressure of at least 0.001 mm Hg at 25° C., said at least one organic solvent present in a solubilizing—or dispersion—effective amount; and f. the remainder, water.

The invention further comprises a method of cleaning soils from hard surfaces by applying said inventive cleaner to a soiled hard surface, and removing both soil and cleaner from said surface.

It is therefore an object of this invention to provide an antimicrobial hard surface cleaner.

It is another object of this invention to provide a rinse-free, all purpose hard surface cleaner.

It is also an object of this invention to provide a hard surface cleaner which, despite having antimicrobial efficacy, has improved greasy soil removal with no adverse effects on filming/streaking performance, surprisingly despite having a hydrophilic cationic surfactant.

DETAILED DESCRIPTION OF THE INVENTION

Figure 1:
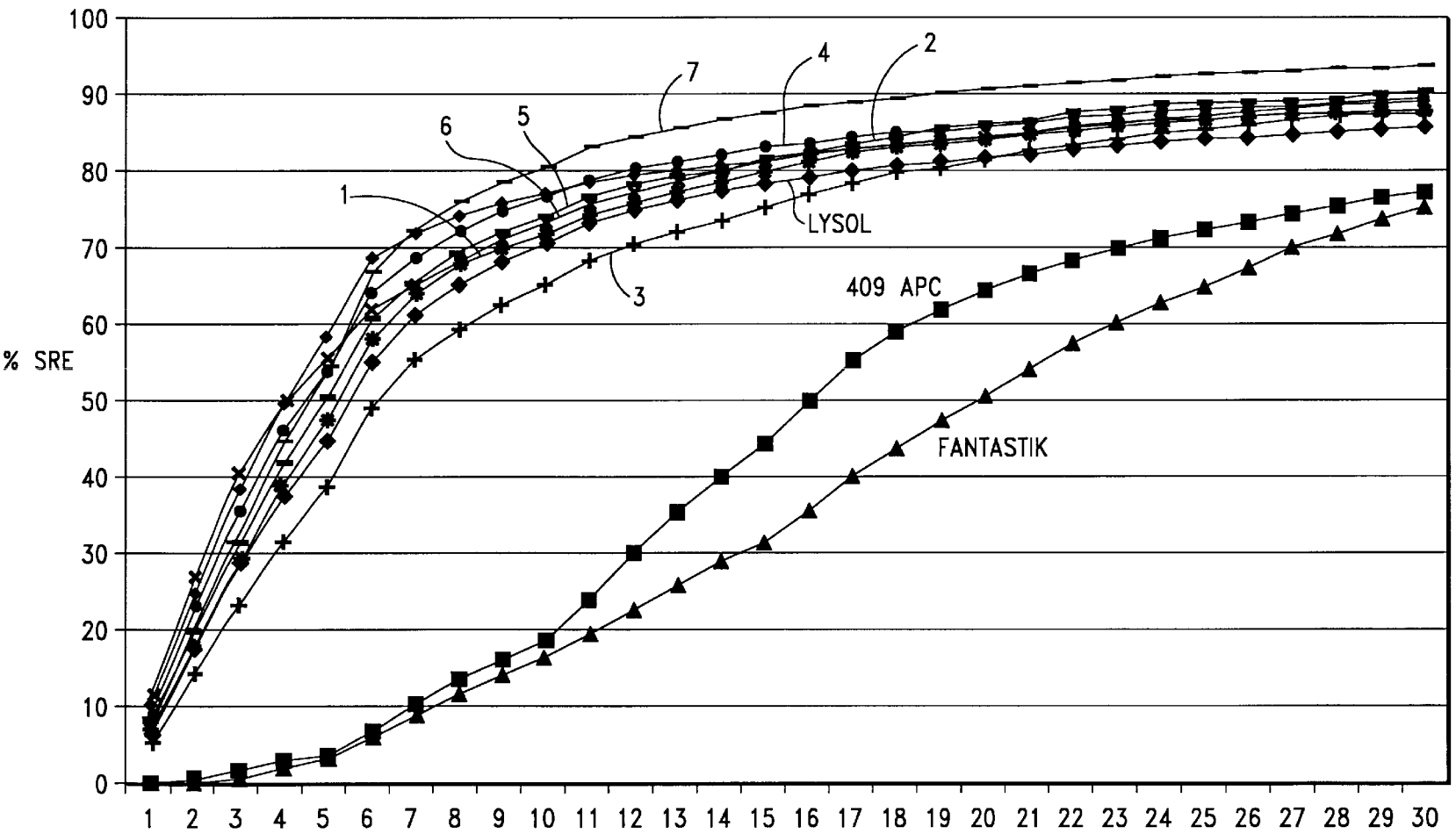
FIG. 1 is a graphical depiction of the greasy soil removal performance of some of the inventive cleaners versus three nationally available all purpose cleaners which include quaternary ammonium compounds as antimicrobial additives.

The invention provides an improved, all purpose antimicrobial cleaner which, despite having antimicrobial efficacy, has improved greasy soil removal with no adverse effects on filming/streaking performance. These types of cleaners are intended to clean hard surfaces by application of a metered discrete amount of the cleaner, typically by pump or trigger sprayer onto the surface to be cleaned or onto the work piece—such as a soft cloth, mop or sponge—and then wiping the surface, thus removing the soil and the cleaner, with or without the need for rinsing with water. In the case of a concentrate, the concentrate is first diluted with water, or water/solvent mixture, then the diluted mixture is applied by work piece or by simply pouring onto the surface to be cleaned. The typical surface is a table, countertop, sink, stove or range top, and other kitchen or dining surfaces; or bathroom surfaces, such as shower stalls, as well as the vertical bathroom wall surfaces (typically made of tile, or composite materials), bathtubs, commodes, lavatories, bidets and sinks. The cleaner is preferably a single phase, clear, isotropic solution, having a viscosity generally less than about 100 Centipoise ("cps") (unless as a concentrate, in which case, below about 100,000 cps). The cleaner itself has the following ingredients:

(a) an alkoxylated quaternary ammonium surfactant, present in a cleaning-effective amount;

(b) an alkoxylated short chain nonionic surfactant, also present in a cleaning-effective amount;

(c) alkanolamine as an alkalinity source present in an amount effective to enhance soil removal in said cleaner;

(d) a quaternary ammonium compound in an amount present for antimicrobial efficacy;

(e) at least one water-soluble or dispersible organic solvent having a vapor pressure of at least 0.001 mm Hg at 25° C., said at least one organic solvent present in a solubilizing—or dispersion—effective amount; and (f) the remainder, water.

Additional adjuncts in small amounts such as buffers, fragrance, dyes, pH adjusting agents (organic or inorganic acid or base) and the like can be included to provide desirable attributes of such adjuncts.

In the application, effective amounts are generally those amounts listed as the ranges or levels of ingredients in the descriptions which follow hereto. Unless otherwise stated, amounts listed in percentage ("%'s") are in weight percent (based on 100% active) of the composition.

1. Surfactants

The surfactants generally comprise a binary system of an alkoxylated quaternary ammonium surfactant, and an alkoxylated alcohol nonionic surfactant. In addition, as described below, a quaternary ammonium compound, is included as an antimicrobial.

a. Alkoxylated Quaternary Ammonium Surfactant

One of the most surprising facets of this invention was the discovery that an alkoxylated quaternary ammonium surfactant would result in enhanced soil removal performance and improved streaking/filming performance. This was very unexpected since it is considered an orthodoxy in surfactant chemistry that quaternary ammonium compounds will cause a large amount of residue to occur on surfaces treated therewith.

The preferred surfactant is an ethoxylated quaternary ammonium surfactant, such as the Berol series from Akzo Nobel. The general structure of the preferred surfactant is:

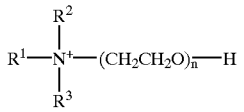

Wherein $R^1$ is $C_{7-14}$, most preferably $C_{9-11}$ alkyl, and, can optionally be ethoxylated, propoxylated, butoxylated, or a combination thereof; $R_2$ and $R_3$ may be the same or not, and are either H, or $C_{1-4}$ alkyl, or $CH_2CH_2O$, $CH_2CH_2CH_2O$, and, preferably, when one of $R_2$ or $R_3$ is H, the other substituent must be selected from $C_{1-4}$ alkyl, or $CH_2CH_2O$, $CH_2CH_2CH_2O$, or $CH_2CH_2CH_2CH_2O$, or a combination thereof; and n may be from 1 to 10, most preferably between 4 and 6. Additionally, the $CH_2CH_2O$ group in the parenthesis, which is an ethoxyl group, may also be propoxyl or butoxyl, or a mixture of any of these three groups. Ethoxyl is most preferred. The amount of this first surfactant should be about 0.01 to 15%, most preferably about 0.1 to 5%, by weight.

The cationic surfactant in Berol 226 is the most preferred hydrophilic cationic (ethoxylated quaternary ammonium) surfactant. Berol 226 actually is a blend with a nonionic surfactant, as described further below.

Although described as the first surfactant, in fact, this hydrophilic cationic surfactant can be used as the sole surfactant herein. However, it is preferred that the hydrophilic cationic surfactant be combined with nonionic surfactant (described below in 1.*b*.) for best results. In fact, the Berol 226 product is actually a blend of hydrophilic cationic surfactant and an ethoxylated alcohol, as further described below.

b. Nonionic Surfactants

The second important surfactant is a nonionic surfactant. It is most preferred that this second, nonionic surfactant be a relatively short chain compound. It is speculated that this compound acts in the nature of a hydrotrope, or coupler, for the formulation. The nonionic surfactants are selected from alkoxylated alcohols, alkoxylated phenol ethers, and other surfactants often referred to as semi-polar nonionics, such as the trialkyl amine oxides. The alkoxylated phenol ethers include octyl- and nonylphenol ethers, with varying degrees of alkoxylation., such as 1–10 moles of ethylene oxide per mole of phenol. The alkyl group can vary from $C_{5-15}$, although octyl- and nonyl chain lengths are readily available. It is most preferred to use a $C_{6-11}$ short chain alcohol with 4–6 moles of ethylene oxide per mole of alcohol. Various suitable products available from Rohm and Haas under the trademark Triton, such as Triton N-57, N-101, N-111, X-45, X-100, X-102, and from Mazer Chemicals under the trademark Macol, from GAF Corporation under the trademark Igepal, from Texaco Chemical Company under the trademark Surfonic. The alkoxylated alcohols include ethoxylated, and ethoxylated and propoxylated $C_{6-16}$ alcohols, with about 2–10 moles of ethylene oxide, or 1–10 and 1–10 moles of ethylene and propylene oxide per mole of alcohol, respectively. Exemplary surfactants are available from Shell Chemical under the trademarks Neodol and Alfonic; and Huntsman. The semi-polar amine oxides are also possible. The amine oxides, referred to as mono-long chain, di-short chain, trialkyl amine oxides, have the general configuration:

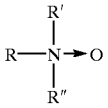

wherein R is $C_{6-24}$ alkyl, and R' and R" are both $C_{1-4}$ alkyl, or $C_{1-4}$ hydroxyalkyl, although R' and R" do not have to be equal. These amine oxides can also be ethoxylated or propoxylated. The preferred amine oxide is lauryl amine oxide. The commercial sources for such amine oxides are Barlox 10, 12, 14 and 16 from Lonza Chemical Company, Varox by Witco and Ammonyx by Stepan Co.

A further possible semi-polar nonionic surfactant is alkylamidoalkylenedialkylamine oxide. Its structure is shown below:

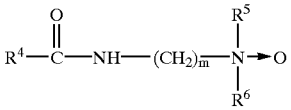

wherein $R^4$ is $C_{5-20}$ alkyl, $R^5$ and $R^6$ are $C_{1-4}$ alkyl,

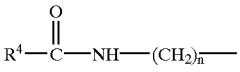

or $—(CH_2)_p—OH$, although $R^5$ and $R^6$ do not have to be equal or the same substituent, and m is 1–5, preferably 3, and p is 1–6, preferably 2–3. Additionally, the surfactant could be ethoxylated (1–10 moles of EO/mole) or propoxylated (1–10 moles of PO/mole). This surfactant is available from various sources, including from Lonza Chemical Company, as a cocoamidopropyldimethyl amine oxide, sold under the brand name Barlox C.

Additionally semi-polar surfactants include phosphine oxides and sulfoxides. Other possible surfactants include amphoterics. The amphoteric surfactant is typically an alkylbetaine or a sulfobetaine. One group of preferred amphoterics are alkylamidoalkyldialkylbetaines. These have the structure:

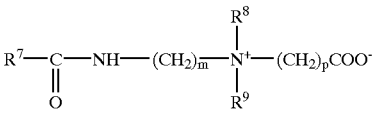

wherein $R^7$ is $C_{6-20}$ alkyl, $R^8$ and $R^9$ are both $C_{1-4}$ alkyl, although $R^8$ and $R^9$ do not have to be equal, and m can be 1–5, preferably 3, and p can be 1–5, preferably 1. These alkylbetaines can also be ethoxylated or propoxylated. The preferred alkylbetaine is a cocoamidopropyldimethyl betaine called Lonzaine CO, available from Lonza Chemical Co. Other vendors are Henkel KGaA, which provides Velvetex AB, and Witco Chemical Co., which offers Rewoteric AMB-15, both of which products are cocobetaines.

As mentioned above, Berol 226 is actually a blend of the hydrophilic, cationic surfactant, plus an ethoxylated alcohol, and it is the preferred mixture of these distinct surfactants. The discussion of further nonionics or amphoterics is thus by nature somewhat speculative. However, if the nonionic or amphoteric were separately added to the invention in addition to the hydrophilic cationic surfactant, it is believed that the amount thereof would be low, perhaps between 0.01 to 2%, most preferably about 0.05 to 1%.

The amounts of surfactants present are to be somewhat minimized, for purposes of cost-savings and to generally restrict the dissolved actives which could contribute to leaving behind residues when the cleaner is applied to a surface. The ratio of the hydrophilic cationic surfactant to the nonionic or amphoteric surfactant is about 20:1 to 1:1, more preferably about 10:1 to 1:1.

The blend of surfactants used in the novel antimicrobial cleaner should, together, have a cloud point between about 30° and about 90° F. (about 0° and about 40° C.), more preferably between about 40° and about 80° F. (about 4° and 27° C.), most preferably between about 45° and about 65° F. (about 7° and 19° C.). "Cloud point" indicates the temperature by which the essentially clear liquid product starts to opacity.

2. Quaternary Ammonium Compound

The invention further generally includes a cationic compound, specifically, a quaternary ammonium compound. These types of compounds are typically used in bathroom cleaners because they are generally considered "broad spectrum" antimicrobial compounds, having efficacy against both gram positive (e.g., Staphylococcus sp.) and gram negative (e.g., *Escherischia coli*) microorganisms. Thus, the quaternary ammonium surfactant, or compounds, are incorporated for bacteriostatic/disinfectant purposes and should be present in amounts effective for such purposes.

The quaternary ammonium compounds are selected from mono-long-chain, tri-short-chain, tetraalkyl ammonium compounds, di-long-chain, di-short-chain tetraalkyl ammonium compounds, trialkyl, mono-benzyl ammonium compounds, and mixtures thereof. By "long" chain is meant about $C_{6-30}$ alkyl. By "short" chain is meant $C_{1-5}$ alkyl, preferably $C_{1-3}$. Preferred materials include Stepan series, such as BTC 2125 series; Barquat and Bardac series, such as Bardac MB 2050, MB 50, 4250Z, and others, from Lonza Chemical. Typical amounts of the quaternary ammonium compound range from preferably about 0.1–5%, more preferably about 0.001–2%.

3. Alkanolamines

Alkanolamines are the preferred solvent/alkalinity source herein. Preferred are monoethanolamine, monopropanolamine and monobutanolamine, with monoethanolamine (MEA) being most preferred. MEA apparently helps to mitigate the reduction in soil removal that typically occurs when quaternary anunonium (especially chloride) compounds are used. Monoethanolamines (and other alkanolamines) should be present in an amount between 0.01 to 5%, most preferably between about 0.1 to 5% by weight.

Additionally, certain low residue chelating agents may be desirable. These include the potassium and ammonium salts of ethylenediaminetetraacetic acid. (See Robbins et al., U.S. Pat. Nos. 6,214,784 and 5,972,876, and Mills et al., U.S. Pat. Nos. 6,004,916 and 5,814,591, all of which are incorporated herein by reference.) Further neutralizing agents, such as potassium hydroxide may also be desirable. As well, pH adjusting agents are desirable. These would include inorganic or organic acids or bases, such as short chain carboxylic acids (citric, acetic, propionic), mineral acids (hydrochloric, sulfiuic, sulfonic, phosphoric, nitric), alkalis (alkali metal hydroxides, alkali metal carbonates, alkali metal silicates, alkali metal phosphates, alkali metal borates) and the bases of weak organic acids (citrates, acetates, propionates, succinates, etc.). Each of these ingredients (alkalinity, chelant, neutralizing and pH adjusting agents) should be added in relatively spare amounts, such as a total between about 0.01 to 2% by weight.

4. Solvents

The solvent is a water soluble or dispersible organic solvent having a vapor pressure of at least 0.001 mm Hg at 25° C. It is preferably selected from $C_{1-6}$ alkanol, $C_{1-6}$ diols, $C_{3-24}$ alkylene glycol ethers, and mixtures thereof. The alkanol can be selected from methanol, ethanol, n-propanol, isopropanol, butanol, pentanol, hexanol, their various positional isomers, and mixtures of the foregoing. It may also be possible to utilize in addition to, or in place of, said alkanols, the diols such as methylene, ethylene, propylene and butylene glycols, and mixtures thereof. A preferred solvent is propylene glycol, available from various suppliers.

It is preferred to use an alkylene glycol ether solvent in this invention. The alkylene glycol ether solvents can include ethylene glycol monobutyl ether, ethylene glycol monopropyl ether, propylene glycol n-propyl ether, propylene glycol monobutyl ether, diethylene glycol n-butyl ether, dipropylene glycol methyl ether, and mixtures thereof. Preferred glycol ethers are propylene glycol n-butyl ether (sold as Dowanol PNB, sold by Dow Chemical Co.), ethylene glycol monobutyl ether, also known as butoxyethanol, sold as butyl Cellosolve by Union Carbide, and also sold by Dow Chemical Co., 2-(2-butoxyethoxy) ethanol, sold as butyl Carbitol, also by Union Carbide, and propylene glycol n-propyl ether, available from a variety of sources. Another alkylene glycol ether is propylene glycol, t-butyl ether, which is commercially sold as Arcosolve PTB, by Arco Chemical Co. The n-butyl ether of propylene glycol is most preferred. Other suppliers of preferred solvents include Union. Carbide. If mixtures of solvents are used, the amounts and ratios of such solvents used are important to determine the optimum cleaning and streak/film performances of the inventive cleaner. It is preferred to limit the total amount of solvent to no more than 50%, more preferably no more than 25%, and most preferably, no more than 15%, of the cleaner. A preferred range is about 1–15%, and a most preferred range is actually 0–5%, since these cleaners can actually be solventless. These amounts of solvents are generally referred to as dispersion-effective or solubilizing effective amounts, since the other components, such as surfactants, are materials which are assisted into solution by the solvents. The solvents are also important as cleaning materials on their own, helping to loosen and solubilize greasy soils for easy removal from the surface cleaned.

5. Water and Miscellaneous

Since the cleaner is an aqueous cleaner with relatively low levels of actives, the principal ingredient is water, which should be present at a level of at least about 50%, more preferably at least about 80%, and most preferably, at least about 90%. Deionized water is preferred.

Small amounts of adjuncts can be added for improving cleaning performance or aesthetic qualities of the cleaner. For example, buffers could be added to maintain constant pH (which for the invention is between about 7–14, more preferably between about 8–13). These buffers include non-heavy metal salts of weak acids, such as NaOH, KOH, $Na_2CO_3$, $K_2CO_3$, as alkaline buffers, and phosphoric, hydrochloric, sulfuric, sulfonic and citric acids as acidic buffers, and others. (These materials were also considered above, in 3.) Because alkanolamines are utilized, the pH will generally be relatively alkaline. Other builders, such as phosphates, silicates, and again, carbonates, may be desirable, but their amounts are preferably minimized since these materials may, in fact, worsen streaking/filming attributes since they may increase residue. Further solubilizing materials, such as hydrotropes, e.g.s., cumene, toluene and xylene sulfonates, may also be desirable. Adjuncts for cleaning include additional surfactants, such as those described in *Kirk-Othmer, Encyclopedia of Chemical Technology*,3rd Ed., Volume 22, pp. 332–432 (Marcel-Dekker, 1983), and *McCutcheon's Soaps and Detergents* (N. Amer. 1984), which are incorporated herein by reference. Aesthetic adjuncts include fragrances, such as those available from Givaudan, IFF, Quest, Sozio, Firmenich, Dragoco and others, and dyes and pigments which can be solubilized or suspended in the formulation, such as diaminoanthraquinones. Water-insoluble solvents may sometimes be desirable as added grease or oily soil cutting agents. These types of solvents include tertiary alcohols, hydrocarbons (alkanes), pine-oil, d-limonene and other terpenes and terpene derivatives, and benzyl alcohols. Thickeners, such as organic polymers, like polyacrylate, starch, xanthan gum, alginates, guar gum, cellulose, and the like, may be desired additives. Antifoaming agents, or foam controlling agents, may be also desirable, such as silicone defoamers. The amounts of these cleaning and aesthetic adjuncts should be in the range of 0–10%, more preferably 0–2%. It is again emphasized that any additives be added in amounts which will not increase streaking/filming of the cleaner.

The formulations of this invention have the following most preferred range of ingredients:

| Ingredients | Weight % |
|---|---|
| Ethoxylated Quaternary Ammonium Surfactant (Berol 226) | .1–2% |
| Ethoxylated (4–6 EO) short chain ($C_{9-11}$) alcohol Nonionic (Vista) | .15–4% |
| Monoethanolamine (builder) | .1 . 5% |
| Quaternary Ammonium Compound (antimicrobial) | .05–2% |
| Organic Solvent (Isopropanol, glycol ether, or both) | 0–15% |
| Chelating Agents | 0.01–4% |
| Dyes/Fragrances/Other aesthetic adjuvant | 0–1% |
| Water | q.s. |

In the following Experimental section, the surprising performance benefits of the various aspects of the inventive cleaner are demonstrated.

EXPERIMENTAL

The following TABLES I and II shows Examples 1–12 of the invention:

TABLE I

| | EXAMPLES | | | | | |
|---|---|---|---|---|---|---|
| Ingredients | 1 | 2 | 3 | 4 | 5 | 6 |
| Berol 226 | 1.0 | 1.0 | 1.0 | 1.0 | 1.0 | .8 |
| Butyl Cellosolve | 3.5 | 1.0 | 1.0 | 3.5 | 2.5 | 3.0 |
| $K_4EDTA$ | .44 | .44 | .44 | .44 | .44 | .44 |
| Mono-ethanolamine | 1.0 | .5 | .5 | .5 | .5 | .5 |
| Barquat MB-50 | .3 | .3 | .3 | .3 | .3 | .3 |
| Stepan BTC 885 | | | | | | |
| Propylene glycol | 1.0 | | 1.0 | | | |
| KOH | | .1 | | | | |
| Water | q.s. to 100% | q.s. to 100% | q.s. to 100% | q.s. to 100% | q.s. to 100% | q.s. to 100% |

TABLE II

| | EXAMPLES | | | | | |
|---|---|---|---|---|---|---|
| Ingredients | 7 | 8 | 9 | 10 | 11 | 12 |
| Berol 226 | 1.0 | 1.0 | 1.0 | 1.0 | 1.0 | 1.5 |
| Butyl Cellosolve | 2.5 | 3.0 | 1.0 | 3.5 | 2.5 | 3.0 |
| $K_4EDTA$ | .44 | .44 | .44 | .44 | .44 | .44 |
| Monoethanolamine | .5 | .5 | .5 | .5 | 1 | 1 |
| Barquat MB-50 | | .3 | .3 | .3 | .3 | .3 |
| Stepan BTC 885 | .1 | | | | | |
| Propylene glycol | 1.0 | | 1.0 | | | |
| KOH | | .1 | | | | |
| Water | q.s. to 100% | q.s. to 100% | q.s. to 100% | q.s. to 100% | q.s. to 100% | q.s. to 100% |

Figure 2:
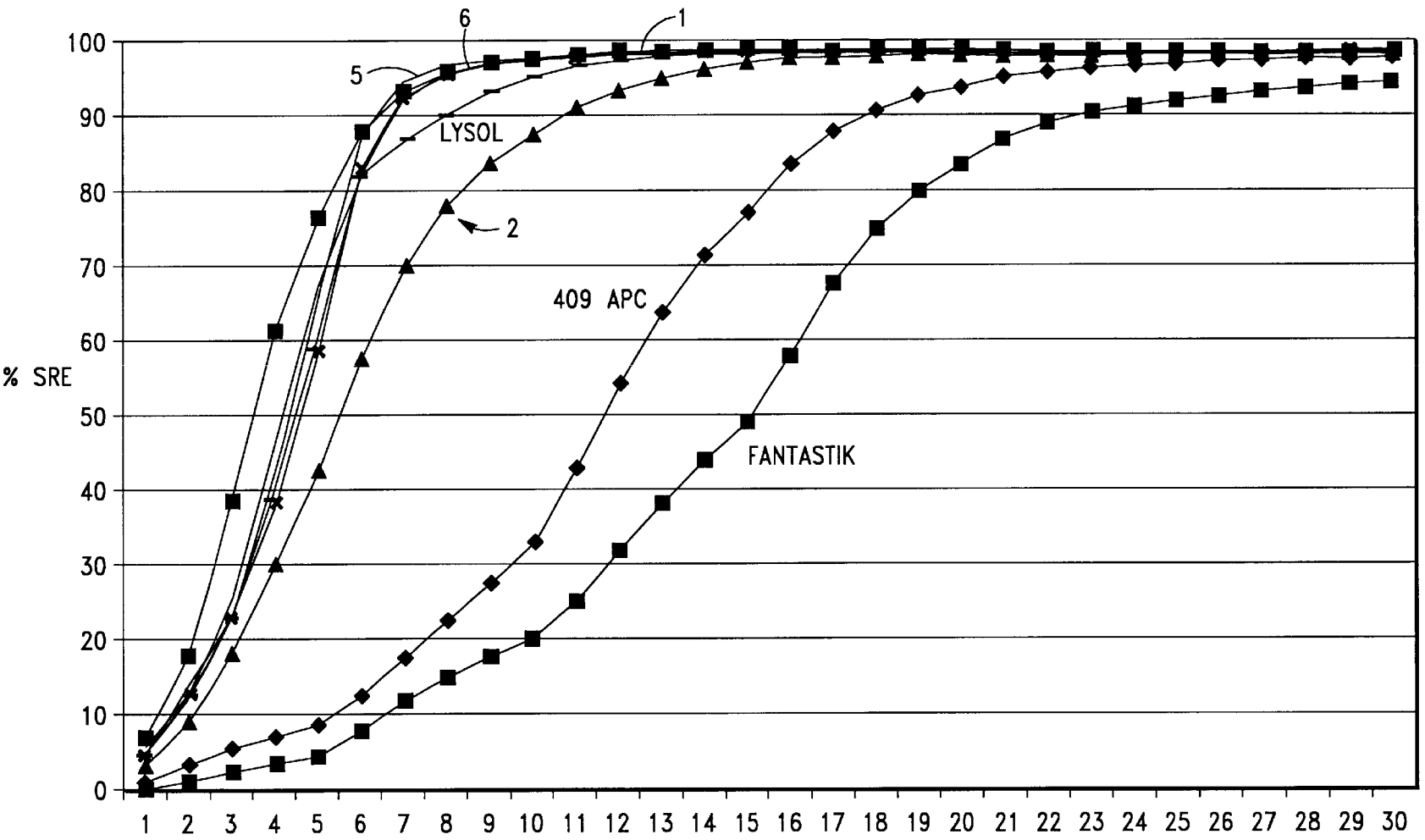
FIG. 2 is a graphical depiction of the greasy soil removal performance of some of the inventive cleaners versus the same three nationally available all purpose cleaners.
Figure 3:
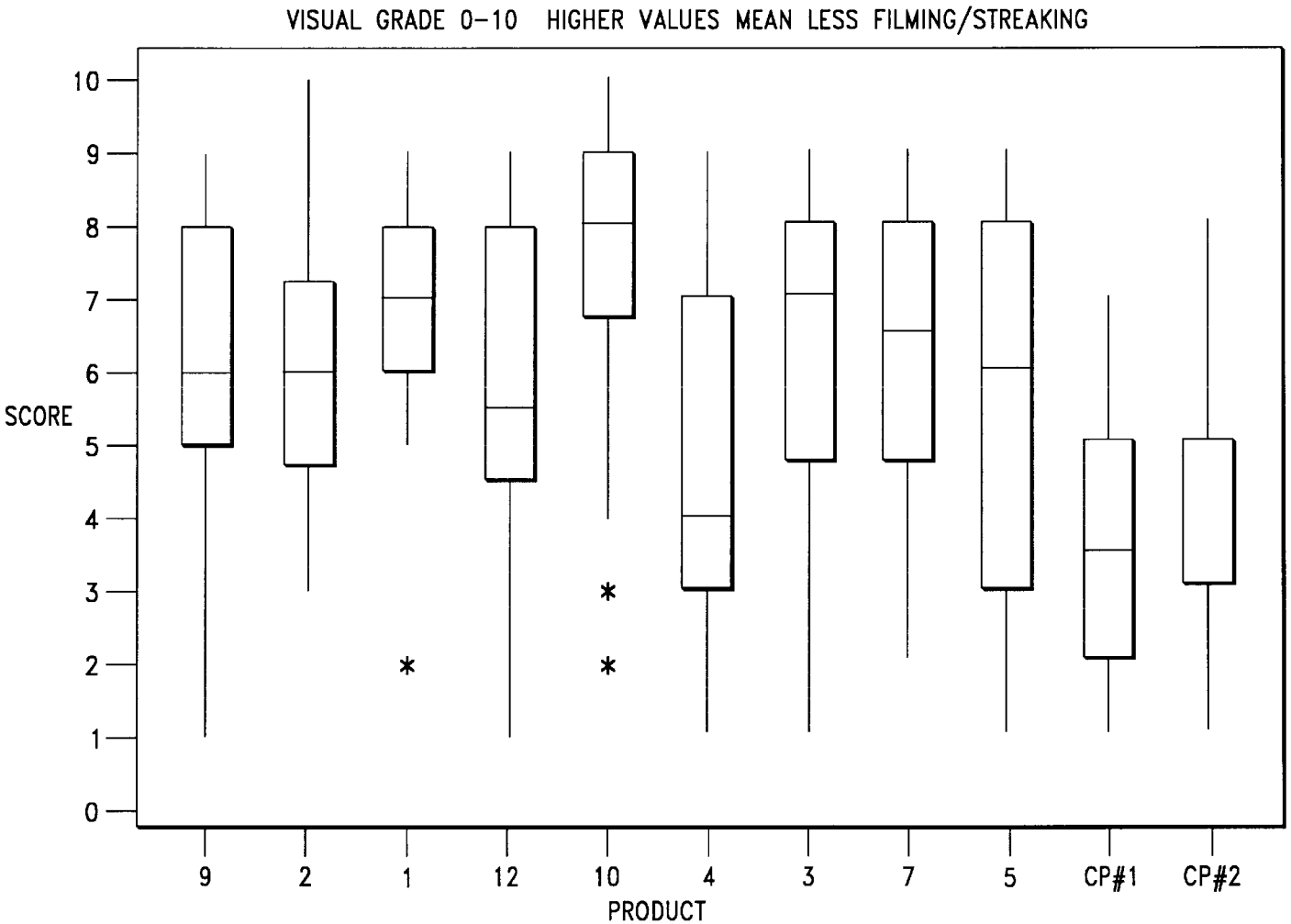
FIG. 3 is a graphical depiction of the streaking/filming performance of some of the inventive cleaners versus two nationally available all purpose cleaners.

The use of these formulas demonstrated superior grease removal versus a current all purpose cleaner, as well as superior kitchen grease removal versus another national all purpose cleaner. The results are depicted in FIGS. 1 and 2. In the test, soil removal performance of the inventive cleaners was conducted. Artificial soils were prepared in accordance with standards developed by the American Society for Testing and Materials ("ASTM") and modified by Applicants. This test was conducted on a proprietary cleaning device in which greasy soil removal is measured by using the proprietary device, which measures the integrated areas under a cleaning profile curve, which is the cumulative amount of soil removed at each cycle. In FIGS. 1 and 2, the Y axis represents the %SRE, or soil removal, while the X axis represents the number of cycles in the soil removal. As can be seen by FIGS. 1 and 2, the higher scores are preferred. In these FIGS. 1 and 2, the inventive examples, indicated as Eg. 7 (etc.) scored higher than either 409 APC (the first nationally available commercial product) and Fantastik (the second nationally available commercial product). The inventive Examples are from Tables I and II. In FIG. 2, most of the inventive examples are in seeming parity in overall greasy soil removal to a third nationally available cleaner, Lysol APC. However, it is noted that the inventive Examples show a steeper incline than Lysol APC, indicating directionally faster cleaning, which, of course, is advantageous. Representative scores of the invention (Eg. 1, 6, 5, 3, 7, 4 and 2 in FIG. 1; 5, 6, 2, 1 in FIG. 2) are shown, but tend to bunch together, demonstrating consistent high performance of the invention.

EXAMPLES 13–23

In the next set of examples, the filming/streaking performance of the invention was compared versus two nationally available commercial products. Filming/streaking performance is measured by comparing each formula against one another and against the commercially available cleaners for filming/streaking on black ceramic tiles. All of these formulas, including the commercial cleaners, contained a quaternary ammonium compound as a biocide. A grading scale of 1 to 10 was used, with 1 being worst and 10 being best. The results are tabulated in FIG. 1 accompanying the application. Here, the Y axis represents the score on a 1 (although plotted to zero) to 10 scale, the X axis indicates the product used, and the invention is portrayed as 9, etc. from Tables I and II, while the comparison examples are CP#1 (409 APC) and CP#2 (Lysol). When there is no overlap between vertical retangular bars in scores, that indicates generally superior performance of the higher scoring product. As can be seen by reviewing the graphically depicted results, generally, superior streaking/filming performance was achieved by the inventive formulations.

EXAMPLES 24–30

In the next seven examples, the surface sanitization and disinfectancy performances of yet further inventive formulations was tested. TABLE III shows the formulations:

| | EXAMPLES | | | | | | |
|---|---|---|---|---|---|---|---|
| Ingredients | 24 | 25 | 26 | 27 | 28 | 29 | 30 |
| Berol 226 | 1.0 | 1.0 | 0.90 | 1.0 | 1.0 | 1.0 | 1.0 |
| Propylene glycol, n-butyl ether | 1.00 | 1.00 | 1.00 | 1.00 | 1.00 | 1.00 | 1.00 |
| Propylene glycol | 1.0 | 1.0 | 1.0 | | | | |
| $K_4$EDTA | .40 | .40 | .40 | .40 | .40 | .40 | .40 |
| Monoethanolamine | .5 | .5 | .5 | | | | |
| Acusol 445N | | | | | 4.9 | 0.30 | |
| 4250Z quat | 0.15 | | 0.09 | 0.15 | 0.20 | 0.15 | 0.10 |
| MB50 quat | | .3 | | | | | |
| Water | q.s. to 100% | q.s. to 100% | q.s. to 100% | q.s. to 100% | q.s. to 100% | q.s. to 100% | q.s. to 100% |
| PH | 11.7 | 11/5 | 11.7 | 12.5 | 12.5 | 12.4 | 12.2 |

These formulations were tested for surface sanitization (This means a product which reduces contaminants in the inanimate environment to levels considered safe according to a public health ordinance, or that reduces the bacterial population by significant numbers where public health requirements have not been established; generally demonstrated by 99.99% contact kill for microorganisms). In this test, a surface contains 5% soil and kill is determined within 30 seconds, with a greater than 99.9% kill needed to establish sanitization. The results are set forth in TABLE IV.

TABLE IV

| | EXAMPLES | | | | | | |
|---|---|---|---|---|---|---|---|
| Surface sanitization vs. microorganism | 24 | 25 | 26 | 27 | 28 | 29 | 30 |
| *E. aerogenes* | >99.99 | >99.99 | 99.99 | >99.99 | >99.99 | >99.99 | >99.99 |
| *S. aureus* | >99.99 | >99.99 | 99.98 | >99.99 | >99.99 | >99.99 | >99.99 |

These data demonstrate that all but Example 26 have surface sanitization performance.

In the next TABLE V, disinfectancy performance is evaluated. Disinfectancy generally means elimination of many or all pathogenic microorganisms on objects or surfaces with the exception of bacterial endospores. The scores are reported as number of surviving colonies from a starting number. Similar to sanitization, 5% soil, with 10 minute contact, in which a score of less than or equal to 1/60 on 3 microorganisms is needed to prove hospital disinfection.

TABLE V

| | EXAMPLES | | | | | | |
|---|---|---|---|---|---|---|---|
| Disinfectancy | 24 | 25 | 26 | 27 | 28 | 29 | 30 |
| *P. aeruginosa* | 0/60 | 0/60 | 0/60 | 0/60 | 0/60 | 0/60 | 0/60 |
| *S. choleraesuis* | 0/60 | 0/60 | 0/60 | 0/60 | not tested | not tested | not tested |
| *S. aureus* | 0/60 | 1/60 | 0/60 | 0/60 | 9/60 | 6/60 | 4/60 |

These Examples demonstrated that formulations 24–27 all provided disinfectancy.

What is claimed is:

1. A, non- or minimized streaking/filming liquid antimicrobial hard surface cleaner, the cleaner comprising:

a. About 0.1–2% of an ethoxylated quaternary ammonium surfactant;

b. About 0.15–4% of an ethoxylated, nonionic surfactant;

c. About 0.05–5% of alkanolamine as an alkalinity source;

d. A quaternary ammonium compound in an amount present for antimicrobial efficacy;

e. About 0–15% of at least one water-soluble or dispersible organic solvent having a vapor pressure of at least 0.001 mm Hg at 25° C.; and f. the remainder, water.

2. The improved cleaner of claim 1 further comprising g. about 0–1% of at least one cleaning adjunct selected from the group consisting of chelating agents, pH-adjusting agents, dyes, and fragrances.

3. The improved cleaner of claim 1 in which ingredients a. and b. are preblended.

4. The improved cleaner of claim 1 in which a. and b. are discretely added components.

5. The improved cleaner of claim 1 in which the organic solvent of e. is selected from $C_{1-6}$ alkanol, $C_{1-6}$ diols, $C_{3-24}$ alkylene glycol ethers, and mixtures thereof.

6. A method of cleaning a hard surface, comprising contacting said surface with the cleaner of claim 1.

* * * * *